US007874176B2

(12) United States Patent
Uihlein et al.

(10) Patent No.: US 7,874,176 B2
(45) **Date of Patent: *Jan. 25, 2011**

(54) DRAWER REFRIGERATOR WITH DIVIDER AND DIVIDER FOR REFRIGERATOR DRAWER

(75) Inventors: Philip J. Uihlein, Mequon, WI (US); Jennifer U. Straszewski, Mequon, WI (US); William A. Reed, Cedarburg, WI (US); Thomas W. Rand, Cedarburg, WI (US); Joseph E. Braun, Brown Deer, WI (US); Jack L. Vaughn, Hartford, WI (US); Andrew J. Doberstein, Hartford, WI (US); Ami M. Verhalen, Sun Prairie, WI (US); Daniel R. Bullis, Jr., Madison, WI (US)

(73) Assignee: U-Line Corporation, Milwaukee, WI (US)

( * ) Notice: Subject to any disclaimer, the term of this patent is extended or adjusted under 35 U.S.C. 154(b) by 83 days.

This patent is subject to a terminal disclaimer.

(21) Appl. No.: 12/364,326

(22) Filed: Feb. 2, 2009

(65) Prior Publication Data

US 2009/0133434 A1 May 28, 2009

Related U.S. Application Data

(63) Continuation of application No. 11/942,440, filed on Nov. 19, 2007, now abandoned, which is a continuation of application No. 11/461,104, filed on Jul. 31, 2006, now Pat. No. 7,296,433, which is a continuation of application No. 10/665,835, filed on Sep. 19, 2003, now Pat. No. 7,082,783.

(51) Int. Cl.
*F25D 11/02* (2006.01)

(52) U.S. Cl. ..... 62/441

(58) Field of Classification Search ..... 62/387, 62/440, 441; 312/402, 404
See application file for complete search history.

(56) References Cited

U.S. PATENT DOCUMENTS

| | | | | |
|---|---|---|---|---|
| 3,988,902 | A * | 11/1976 | Jacobs | 62/136 |
| 4,751,826 | A | 6/1988 | Kawahara et al. | |
| 5,056,332 | A | 10/1991 | Tajima et al. | |
| 5,277,039 | A | 1/1994 | Haasis | |
| 5,435,255 | A | 7/1995 | Elseser et al. | |
| 6,253,568 | B1 | 7/2001 | Peffley | |
| 6,446,459 | B1 | 9/2002 | Sawhney et al. | |

(Continued)

OTHER PUBLICATIONS

Sub-Zero Freezer Company, IN C.; 700BR Refrigerator Drawers; Sub-Zero website—Printed Dec. 15, 2003; Copyright 2002 Sub-Zero Freezer Company, Inc.

*Primary Examiner*—Melvin Jones
(74) *Attorney, Agent, or Firm*—Quarles & Brady LLP

(57) ABSTRACT

A drawer refrigerator has a partitioned cabinet with one or more pull-out drawers. The pull-out drawer(s) can have an adjustable divider fence for dividing the storage space of the drawer. The divider fence can have two dividers each defined by two spaced apart elongated rods that are coupled together at a hub and have end pieces with flat surfaces that abut inside surfaces of the drawer walls. A hand operated screw knob mounted to the hub can be used to lock the position of the divider fence.

20 Claims, 12 Drawing Sheets

U.S. PATENT DOCUMENTS 6,447,083 B1 9/2002 Chiapetta et al.
6,449,976 B1 9/2002 Chai et al.
6,603,660 B1 8/2003 Ehn et al.
7,296,433 B2 11/2007 Uihlein et al.

* cited by examiner

DRAWER REFRIGERATOR WITH DIVIDER AND DIVIDER FOR REFRIGERATOR DRAWER

CROSS-REFERENCE TO RELATED APPLICATIONS

This application is a continuation of application Ser. No. 11/942,440, filed Nov. 19, 2007, now abandoned which is a continuation of application Ser. No. 11/461,104, filed Jul. 31, 2006, issuing as U.S. Pat. No. 7,296,433 on Nov. 20, 2007, which is a continuation of application Ser. No. 10/665,835, filed Sep. 19, 2003, which issued as U.S. Pat. No. 7,082,783 on Aug. 1, 2006.

STATEMENT OF FEDERALLY SPONSORED RESEARCH OR DEVELOPMENT

Not applicable.

BACKGROUND OF THE INVENTION

1. Technical Field

The present invention relates to refrigerated food and drink storage units, and in particular, to compact drawer refrigerators in which the storage space is defined by one or more pull-out door drawers.

2. Description of the Related Art

Refrigerators and coolers for the cold storage of food and beverage items are well known. Many conventional refrigerators and beverage coolers have one or more doors that are hinged to the front side of the cabinet. Food and beverages are ordinarily stored on shelves in the cabinet and the door(s) as well as in slide out crisper drawers near the bottom of the cabinet. This is common for industrial and residential refrigerators and beverage coolers as either full-size standup units or compact, under-cabinet units.

Drawer refrigerators are also well known in which the doors are replaced by pull-out drawers having bins in which the food is stored. Drawer refrigerators can be preferred in certain applications, such as low, under-cabinet applications, because the food items can be slid out of the cabinet in the drawer and thereby be accessed more easily. Often such drawer refrigerators have two, or possibly more, pull-out drawers that are arranged side by side or vertically stacked one above the other so that not all of the items are stored in the same drawer.

One problem with stacked drawer refrigerators is that there is considerable temperature variance between the two drawers, such that one drawer, typically the lower drawer, gets colder than the other. This can frustrate the user because, for example, in order for the upper drawer to be at the desired temperature, the lower drawer may be at a temperature that is colder than it should be for beverages or other items. This can be avoided by using two separate evaporator assemblies for each drawer, but at considerable expense. Or, the refrigerator can have a single evaporator, likely at the bottom of the unit, and an active airflow control assembly, such as including movably louvers and an air mover. Again, however, this adds considerable expense to the unit as well as occupies additional space in the interior which could otherwise be used for cold storage.

Another common issue with drawer refrigerators (with any number or arrangement of drawers) is the efficient allocation of space, that is how to maximize storage capacity within standard height, width and depth dimensions while keeping the items easily accessible. This is a particularly difficult issue to address in drawer refrigerators because of their inherent lack of shelving, unlike conventional hinged door refrigerators, which makes it easy to store items vertically above one another without making them difficult to access, as would be the case if the items were stacked directly on top of each other.

Accordingly, an improved drawer refrigerator with more uniform cooling and improved storage capacity and accessibility features is desired.

SUMMARY OF THE INVENTION

The present invention provides a divider fence for a drawer refrigerator and a drawer refrigerator having a divider fence for adjustably compartmentalizing the interior storage space of a refrigerator drawer.

Specifically, in one aspect the invention is a divider fence having first and second dividers for extending between respective first and second pair of drawer walls. The first and second dividers being coupled at a hub, which in a locked position inhibits sliding of the first divider with respect to the second divider and in an unlocked position allows sliding of the first divider with respect to the second divider.

In another aspect, the invention provides a drawer refrigerator having a cabinet, a drawer with front, rear and opposite side walls slidably mounted to the cabinet, and a divider fence having first and second dividers. The first divider extends between the front and rear walls and the second divider extends between the side walls. The first and second dividers are coupled at a hub, which in a locked position inhibits sliding of at least one of the dividers with respect to the other divider and in an unlocked position allows sliding of the at least one divider.

The hub can be locked by a locking member mounted to the hub at different positions when in the locked and unlocked positions. The locking member then inhibits sliding of the first divider when in the locked position by contacting the first divider. The locking member can be rotatably mounted to the hub, such as in the form of a threaded turn knob.

The dividers can be elongated rods. End pieces mounted can be mounted to ends of the elongated rods. The end pieces can have flat surfaces for contacting the drawer walls. The hub can have open-ended through openings receiving the rods. The openings can be disposed essentially perpendicular to one another. Each divider can have a pair of spaced apart elongated rods, which overlap in a longitudinal dimension of the hub.

The divider fence can thus be used to divide and compartmentalize the interior storage space of a refrigerator drawer. The size of the compartments can be adjusted readily by turning the locking knob and sliding one or more of the dividers as desired. The dividers can be slid near perpendicular walls of the drawer bin or removed completely when there is no need to divide up the storage space.

These and still other advantages of the invention will be apparent from the detailed description and drawings. What follows is a preferred embodiment of the present invention. To assess the full scope of the invention the claims should be looked to as the preferred embodiment is not intended as the only embodiment within the scope of the invention.

DETAILED DESCRIPTION OF THE PREFERRED EMBODIMENT

Figure 1:
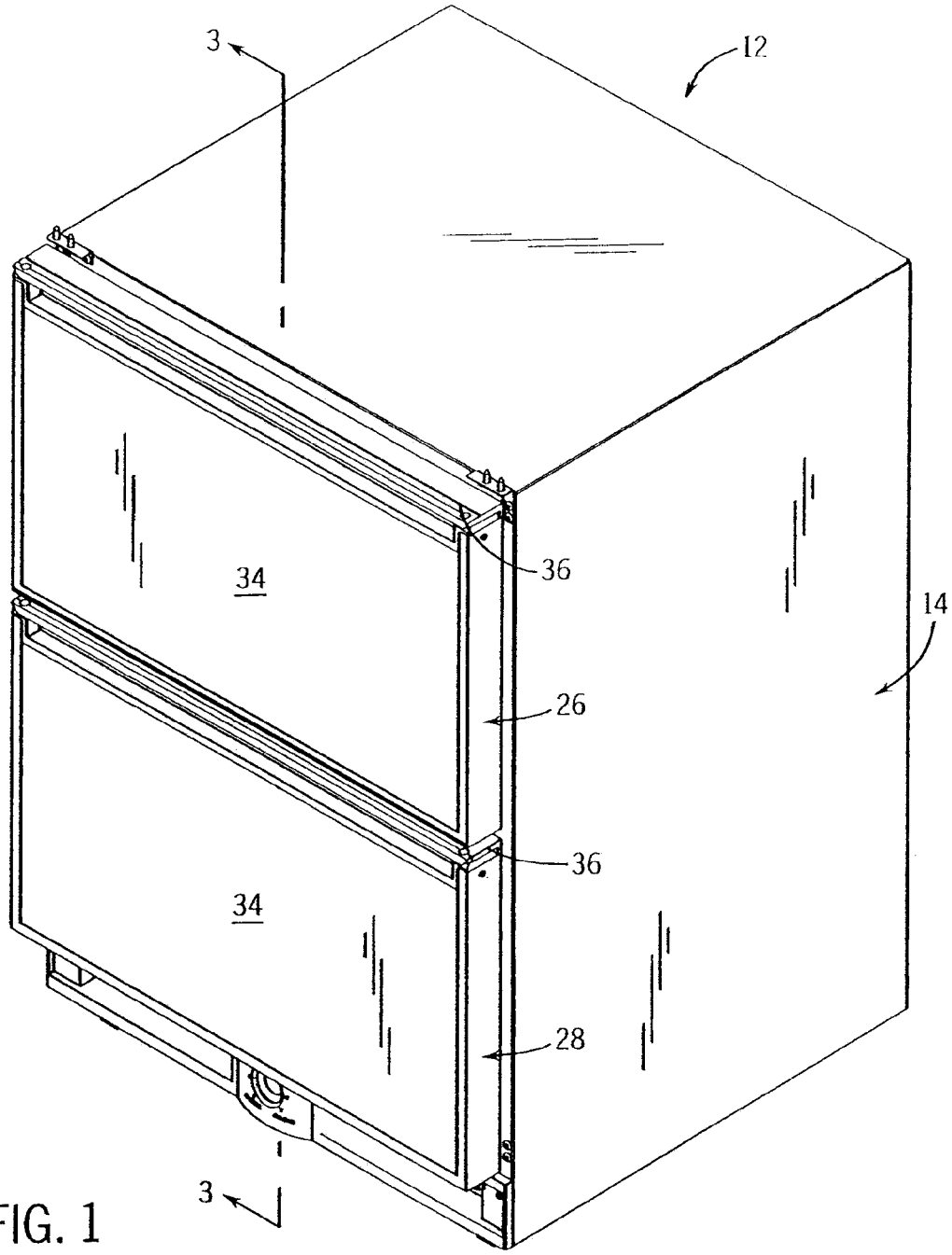
FIG. 1 is a perspective view of the stacked drawer refrigerator of the present invention.
Figure 2:
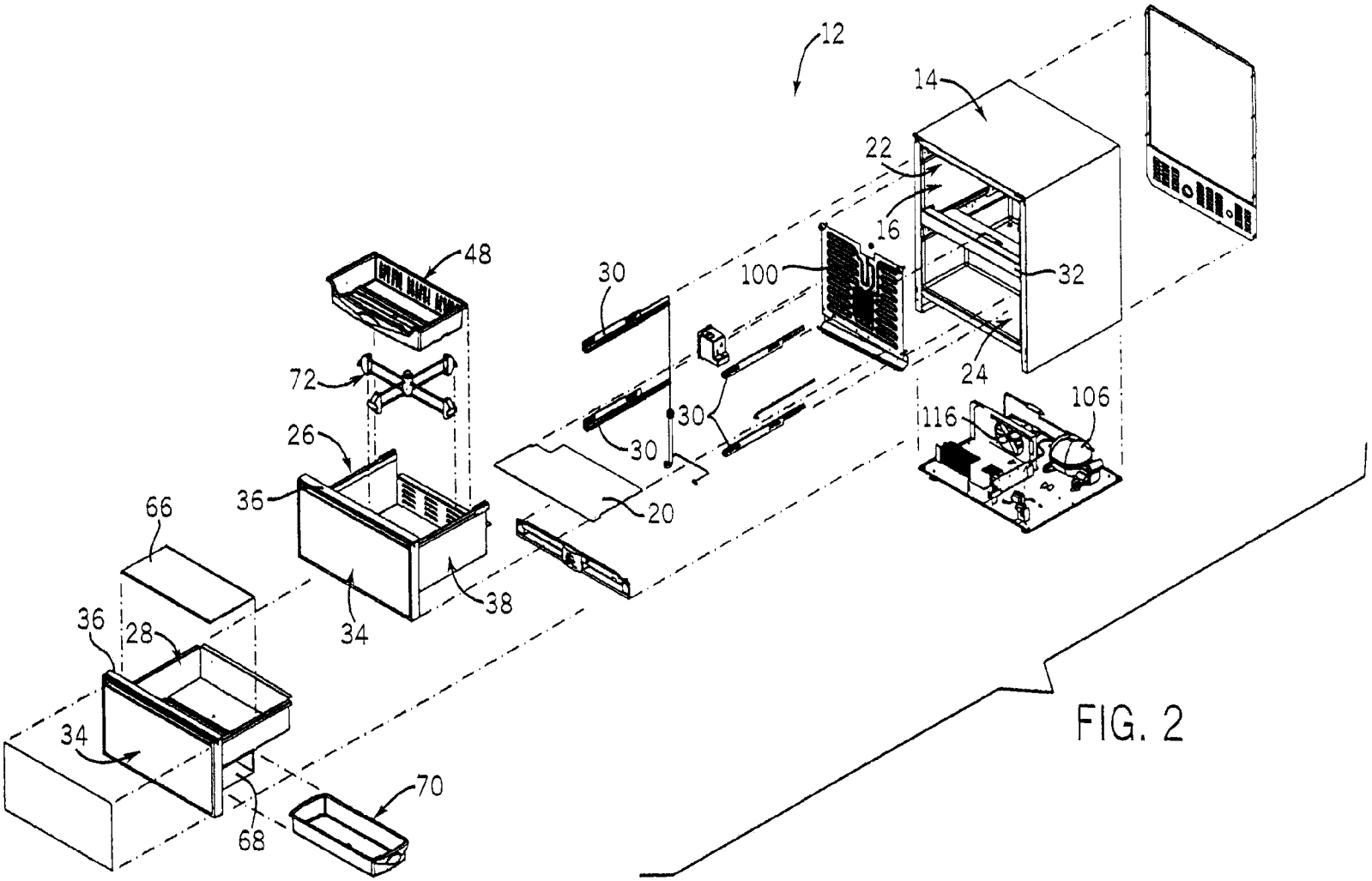
FIG. 2 is an exploded perspective view thereof.
Figure 3:
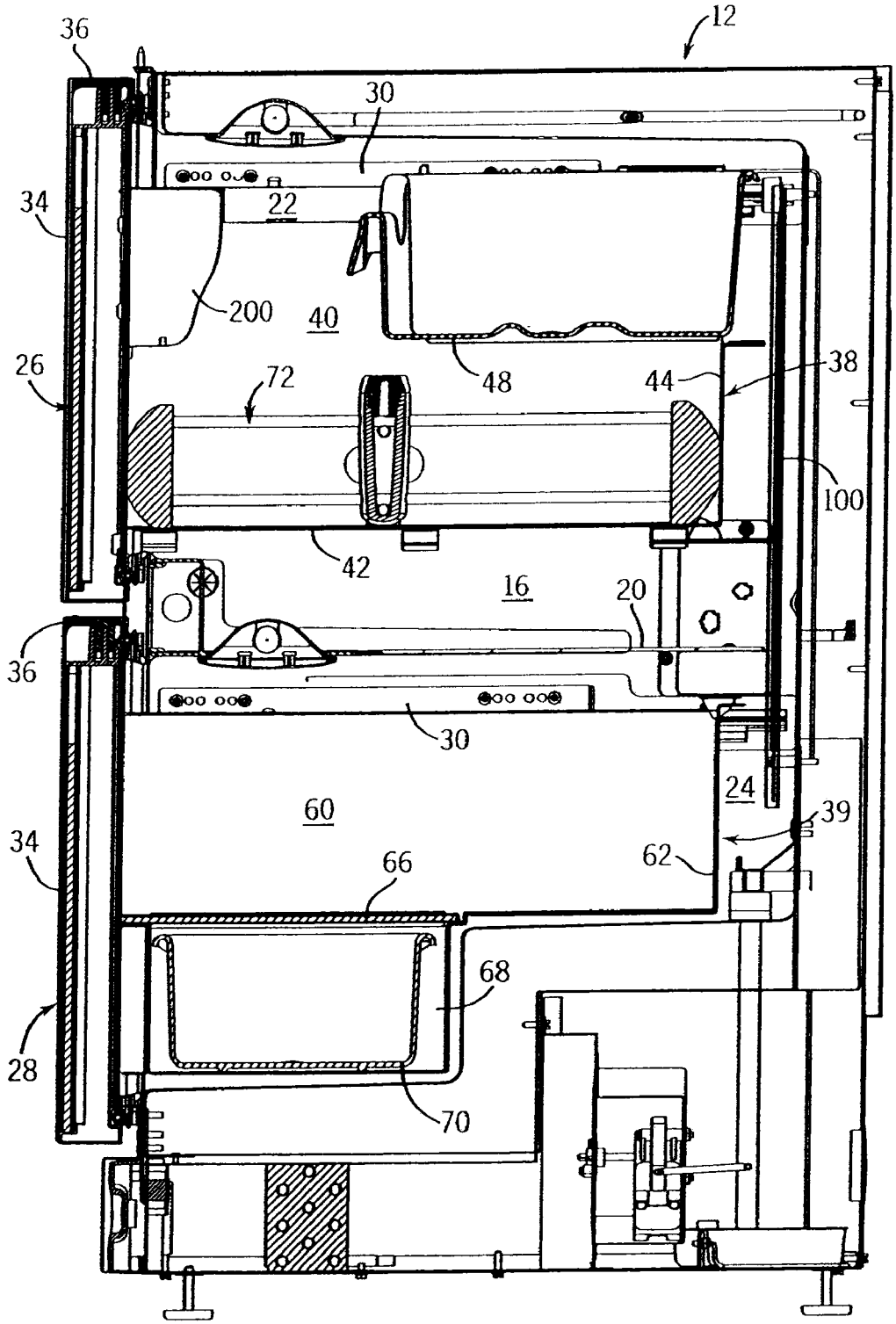
FIG. 3 is a side cross-sectional view taken along line 3-3 of FIG. 1.
Figure 4:
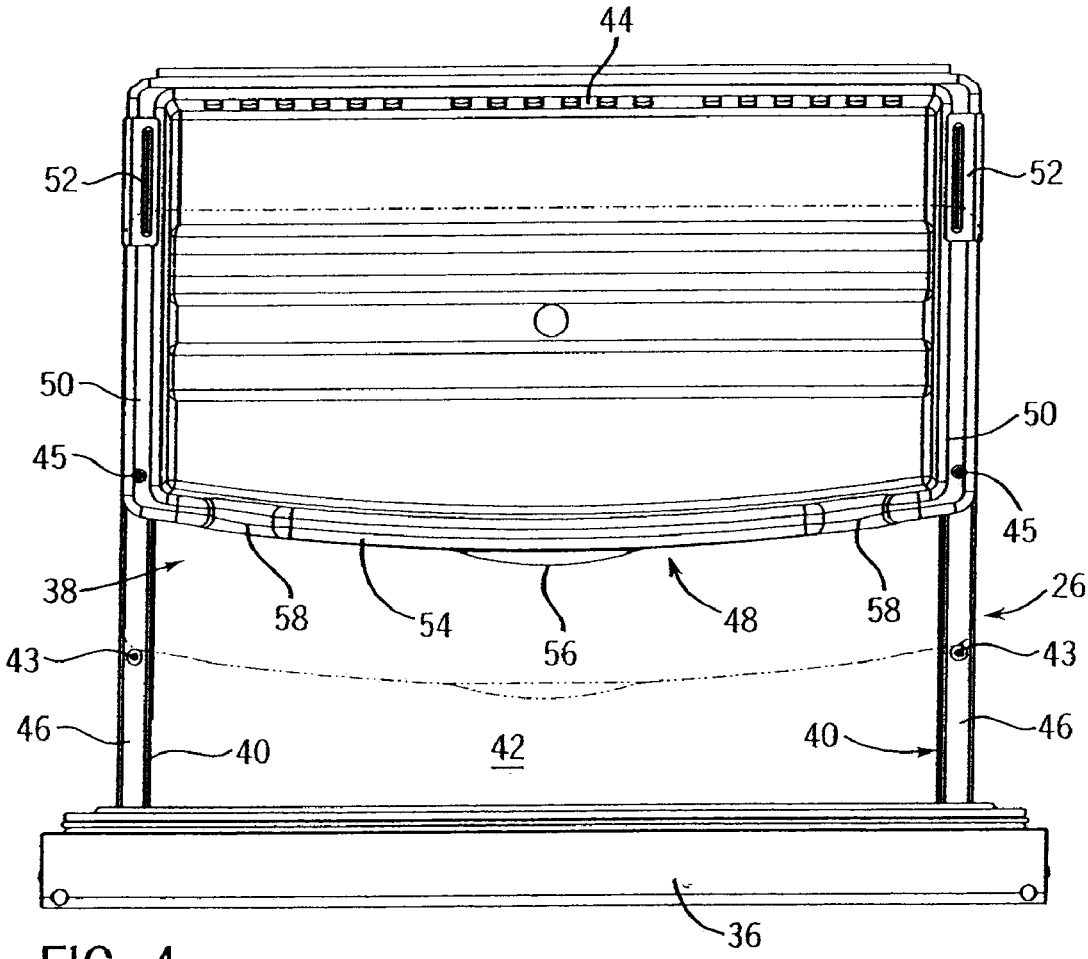
FIG. 4 is a top view looking down into an upper drawer on which a slidable bottle bin rests.
Figure 5:
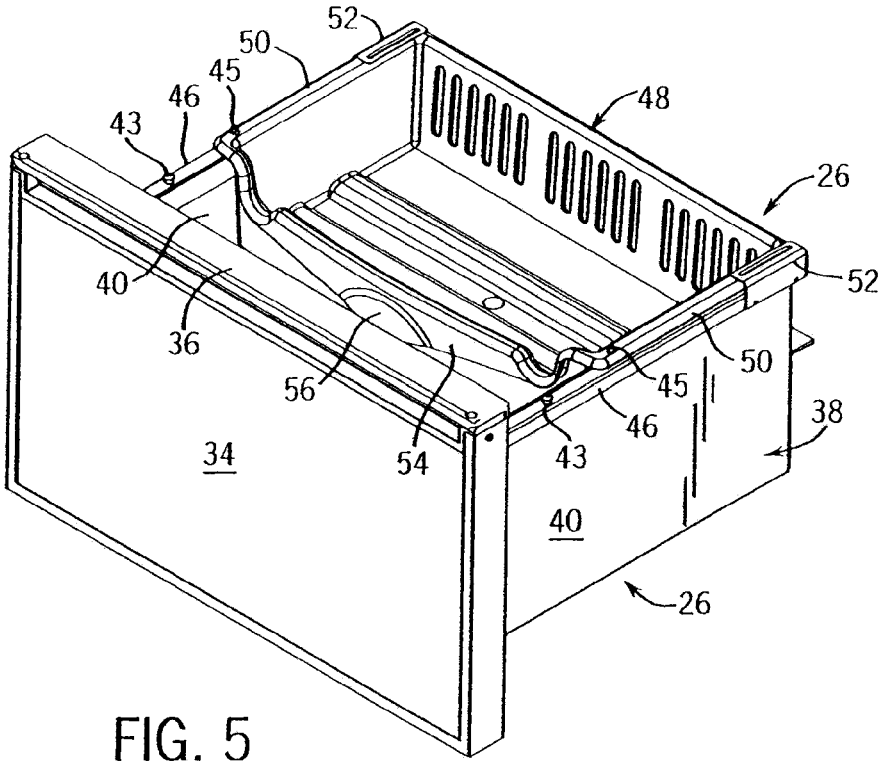
FIG. 5 is a perspective view of the upper drawer with the bottle bin shown positioned at the back of the upper drawer.
Figure 6:
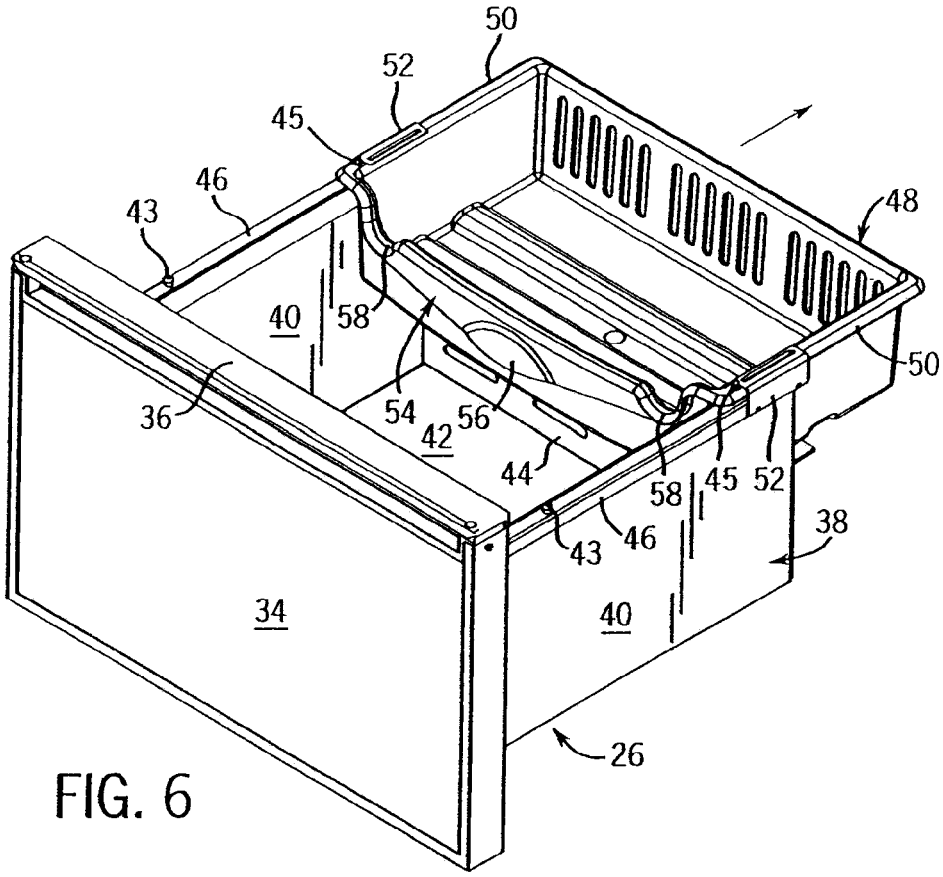
FIG. 6 is a perspective view similar to FIG. 5 albeit with the bottle bin shown in a fully retracted position.

Referring now to FIGS. 1-3, the drawer refrigerator 12 includes a cabinet 14 defining an internal chamber 16 open at a front opening 18. The chamber 16 is divided vertically by a partition 20 into two vertically aligned drawer cavities 22 and 24 in which are mounted two drawers 26 and 28, respectively, by suitable slide mechanisms 30 (see FIG. 3) mounted to the inside of the cabinet 14. The cabinet 14 and the drawers 26 and 28 are formed of inner and outer members, of molded plastic or formed metal, with the space therebetween filled with foam insulation as known in the art. A mullion 32 extends across the front opening 18 between the drawers 26 and 28 to support the front edge of the partition 20, which is suitably supported at its side and back edges as well. The mullion 32 can be heated by a low wattage surface heater (not shown) to remove any condensation that may occur during operation of the refrigerator.

Each of the pull-out drawers 26 and 28 have a front door panel 34 with a handle 36 along a top edge and which is designed to be fit with an overlay panel (not shown) matching the cabinetry where the unit is installed. Details of the handle construction and the overlay panel attachment can be found in co-owned pending application Ser. No. 10/076,746, filed Feb. 14, 2002. Attached to the door panels 34 are drawer bins 38 and 39 of slightly different configuration between the respective upper 26 and lower 28 drawers. The upper drawer 26 has deeper opposite side walls 40 joined at their bottom edges to a bottom wall 42 and at their back edges by a vented rear wall 44 that extends only about half the height of the side walls 40 so that its top edge is set down from the top edges of the side walls 40. Two, preferably plastic, runners 46 are attached, preferably with adhesive, onto the top edges of the side walls 40 to allow a bottle bin 48 to slide thereon.

In particular, with reference to FIGS. 4-7, the bottle bin 48 has guides 50 at its sides that wrap over the top of the runners 46 to allow front to back sliding but limit side to side motion. The bottle bin 48 can slide from forward travel limiting stops 43 projecting up from the side walls 40 to the rear wall 44 and even past the rear wall 44 when the drawer 26 is open sufficiently so as to nearly completely clear from the top of the drawer 26 and allow nearly full access to the items in the drawer bin. This full retraction of the bottle bin 48 is permitted by the clearance of the half-height rear wall 44 and by hold-down brackets 52 welded to the side walls 40 and spaced vertically from the runner 46 that capture the top end of the bottle bin guides 50. The brackets 52 hold down the front side of the bottle bin 48 to prevent it from tipping backwards when fully retracted and rearward travel limiting stops 45 projecting up from the tops of the guides 50 contact the brackets 52 and prevent the bottle bin 48 from sliding off of the drawer bin 38 (see FIG. 6). The bottle bin 48 can be removed by pulling it toward the door panel 34 and tilting its front end up until its back end clears the brackets 52.

Figure 7:
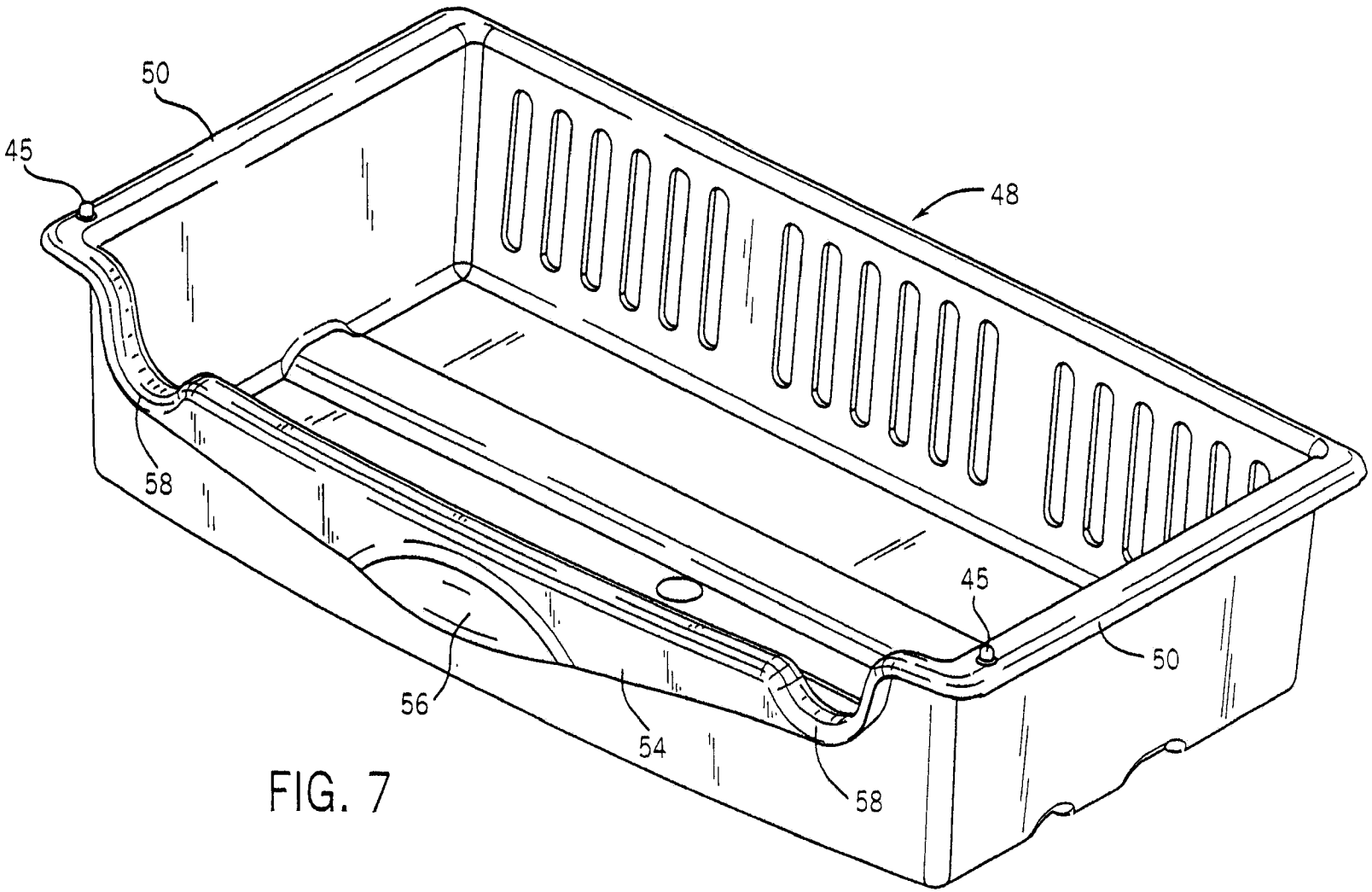
FIG. 7 is a perspective view of the bottle bin.

As shown in FIG. 7, the bottle bin 48 is a molded plastic tray or container having a bottom and four upright walls. The back wall is vented and the lip or flange of the side walls defines the guides 50. The front wall bows slightly and extends to a lesser height that the other walls. The curled lip 54 of the front wall defines a handle 56 in the middle as well as two bottle retainers 58 in the form of round, nearly semicircular recesses. These bottle retainers 58 are designed to cradle the necks of wine, soda and like bottles that may be stored in the bottle bin 48. The front to back dimension of the bottle bin 48 is designed to allow standard wine bottles to lie flat in the bottle bin 48 with the neck cradled in the bottle retainers 58 and the side to side dimension allows standard 2-liter bottles to lie across the bottle bin 48. As the name suggests, the bottle retainers 58 secure the bottles by resisting side to side as well as back to front movement of the bottles. Yet, they allow the bottles to be simply lifted from the bottle bin 48 when desired.

Figure 8:
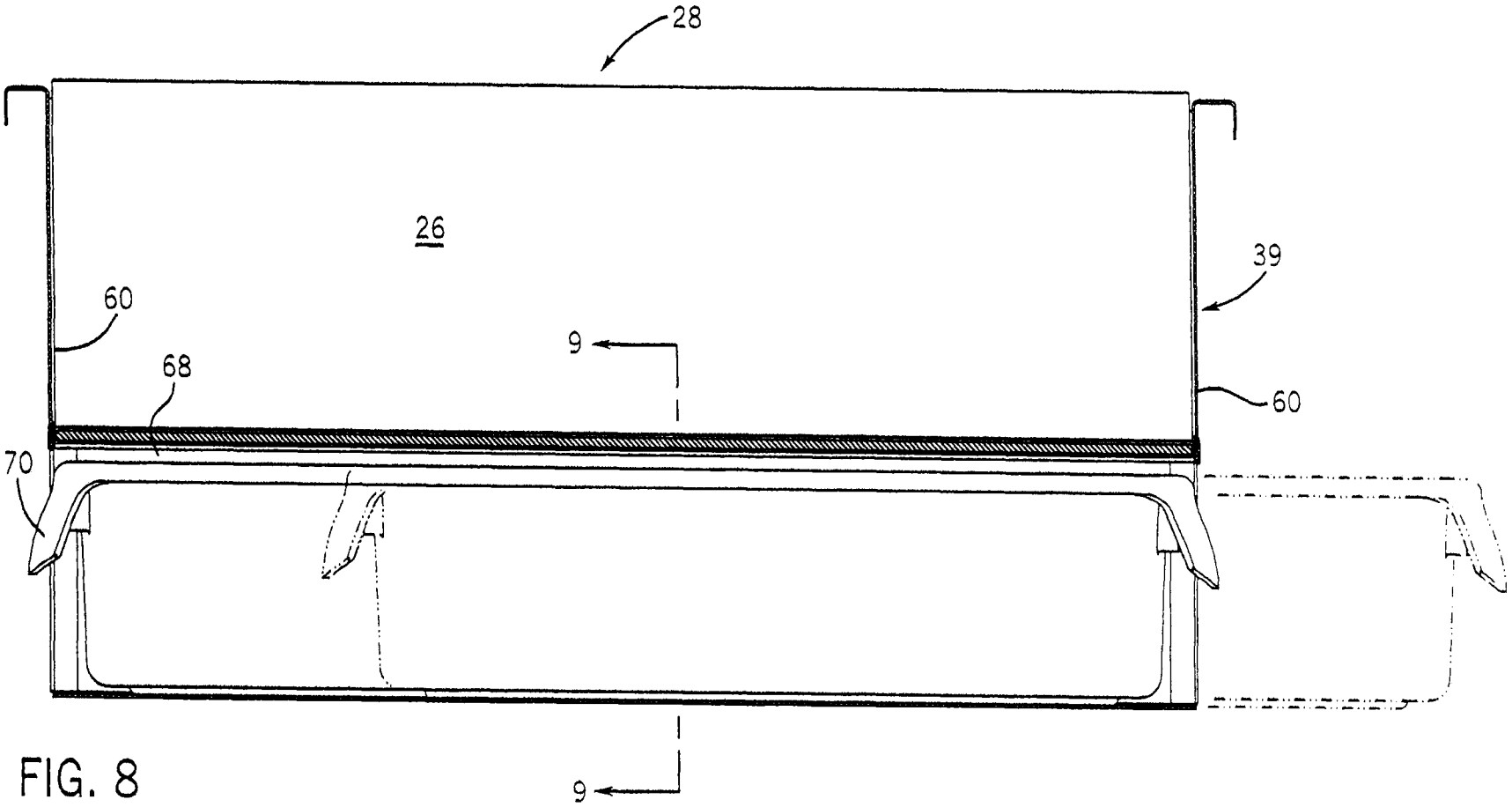
FIG. 8 is a front sectional view of a lower drawer showing a side access compartment containing a slide out storage bin.
Figure 9:
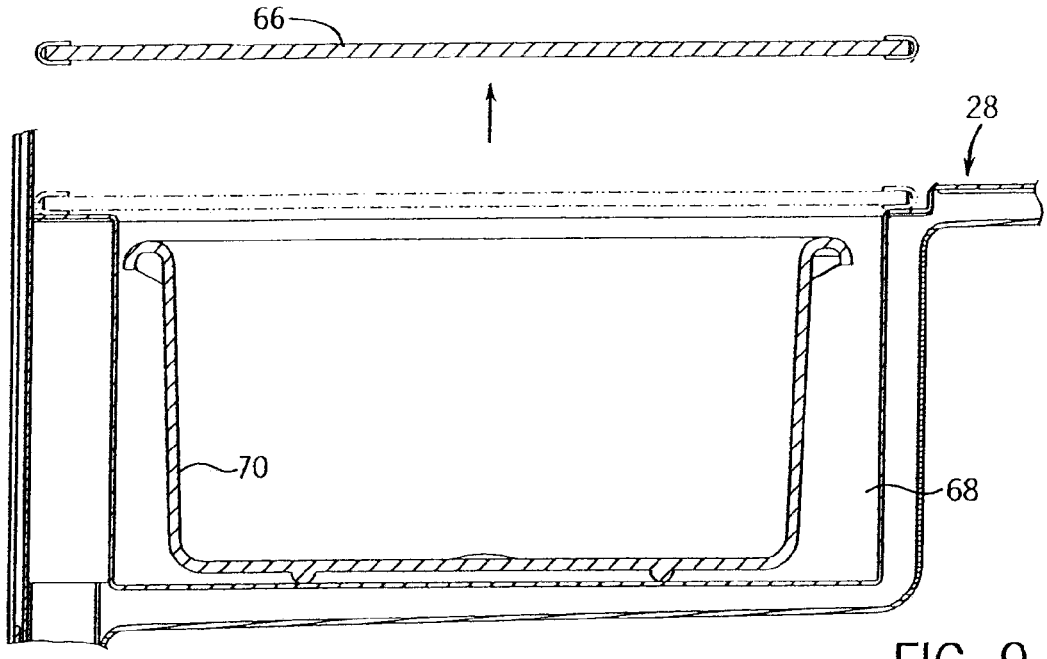
FIG. 9 is a partial side sectional view of the lower drawer and side access compartment with a translucent panel shown removed.
Figure 12:
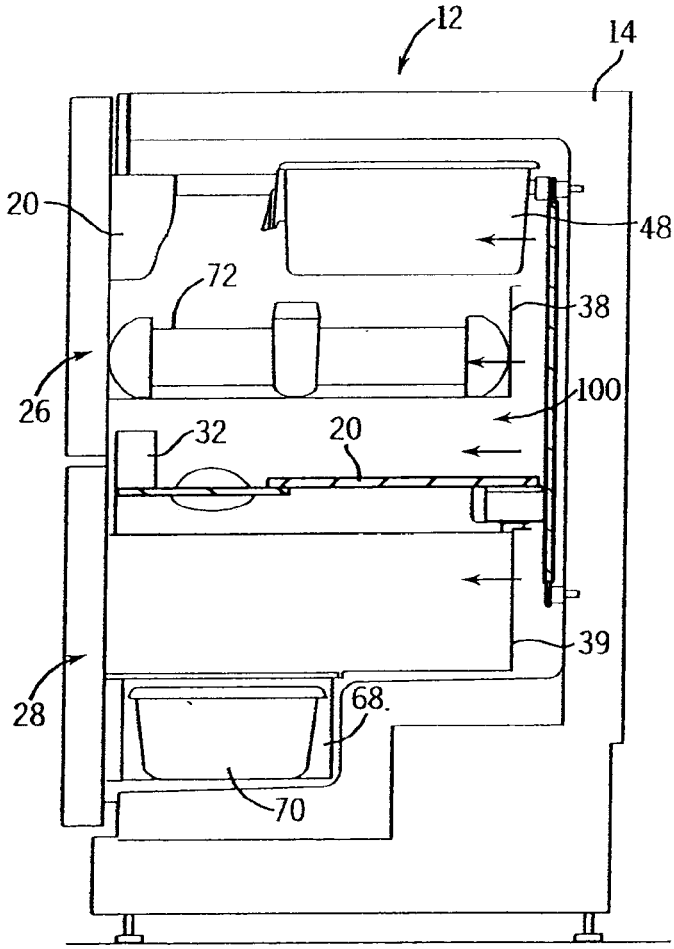
FIG. 12 is a diagrammatic representation of the inside of the refrigerator cabinet with arrows representing the generally segregated air masses in the upper and lower drawer cavities.
Figure 10:
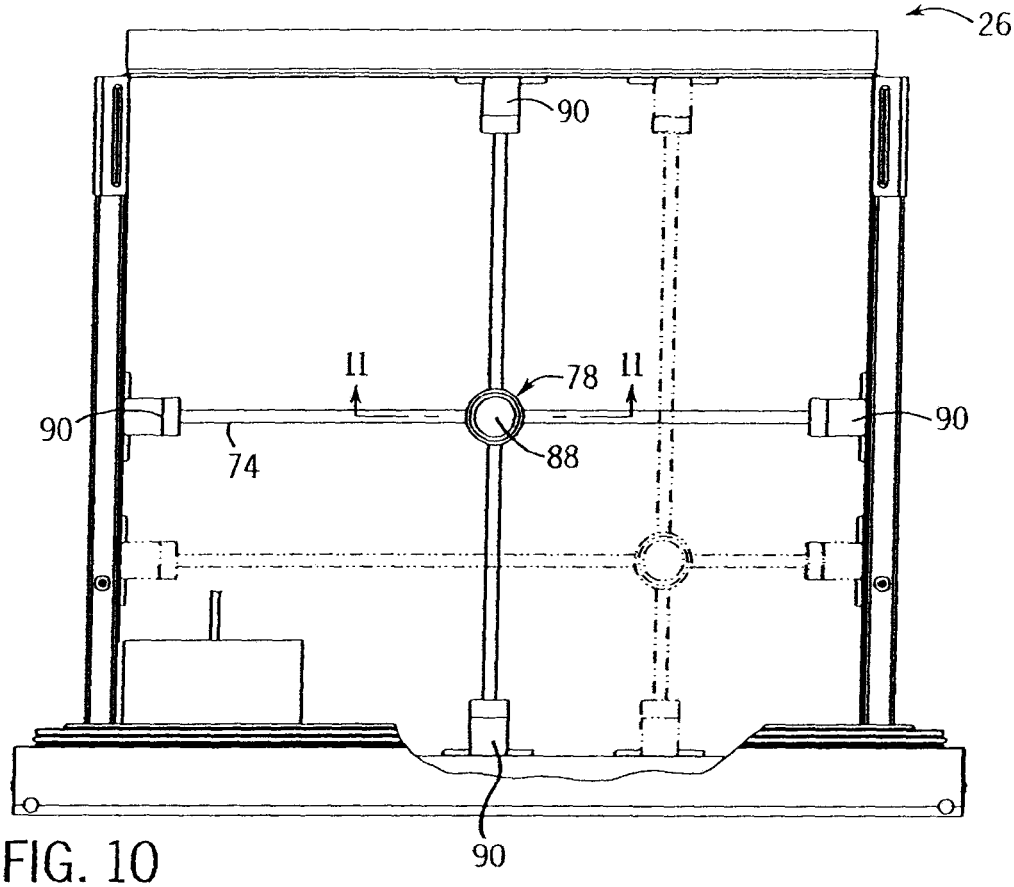
FIG. 10 is a top view looking down into the upper drawer at an adjustable fence mechanism therein.
Figure 11:
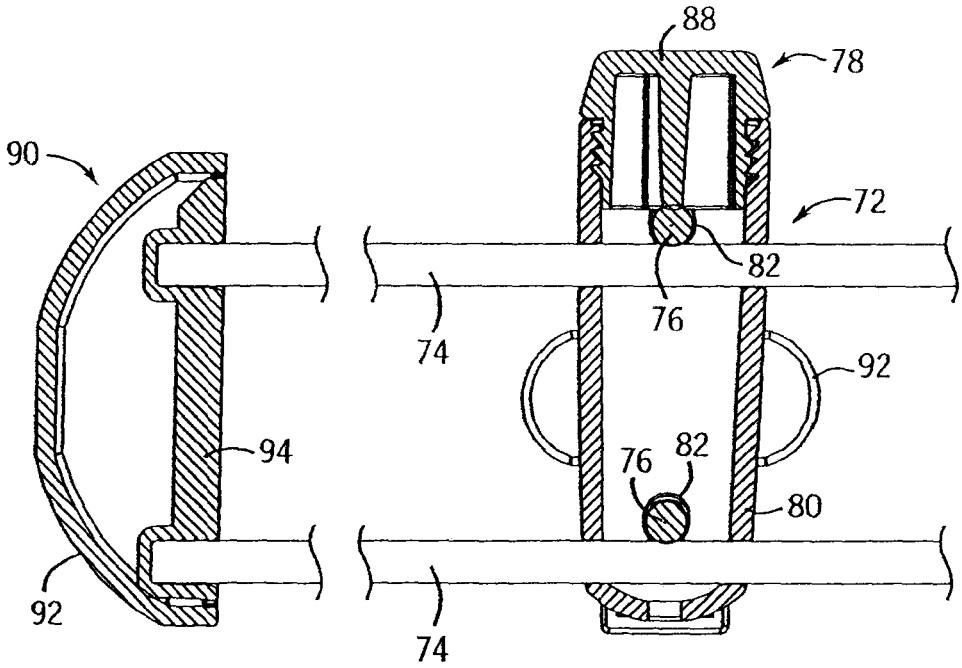
FIG. 11 is a cross-sectional view taken along line 11-11 of FIG. 10 showing the locking hub feature of the adjustable fence.

Referring to FIGS. 8 and 9, the lower drawer 28 has a shallower drawer bin 39 defined by shorter side 60 and rear 62 walls. The bottom 64 of the drawer bin 39 is formed in part by a translucent removable panel 66 that permits viewing, and removed access, into a side access compartment 68 located beneath the drawer bin 39 behind the door panel 34. This compartment 68 is a channel, generally rectangular in cross-section and parallel to the door panel 34, that is open-ended at the sides of the drawer 28. The compartment 68 holds a plastic storage bin 70, such as a crisper tray, that when the drawer 28 is open can fit into and be removed from the compartment 68 from either open end or from its top side through the interior of the drawer bin 39 by lifting off panel 66 (and any items stored thereon).

Figure 15:
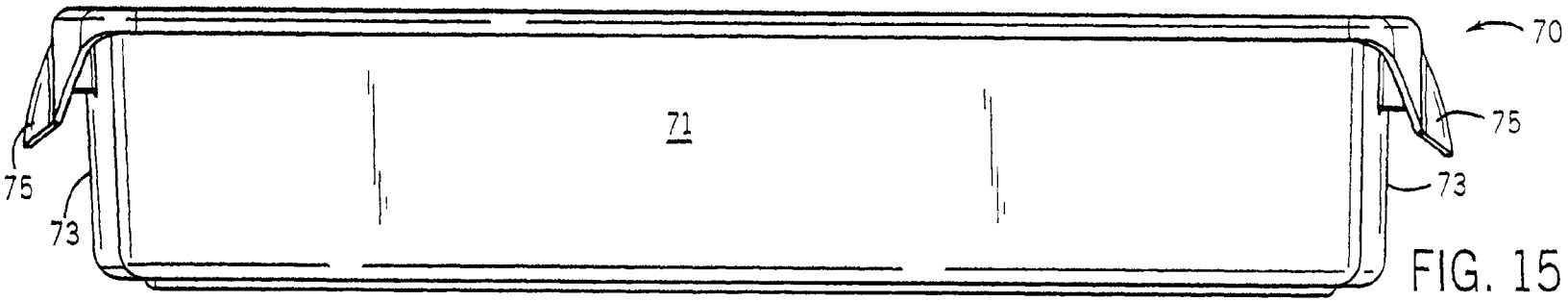
FIG. 15 is a side elevational view of the slide out storage bin shown in FIG. 8.
Figure 16:
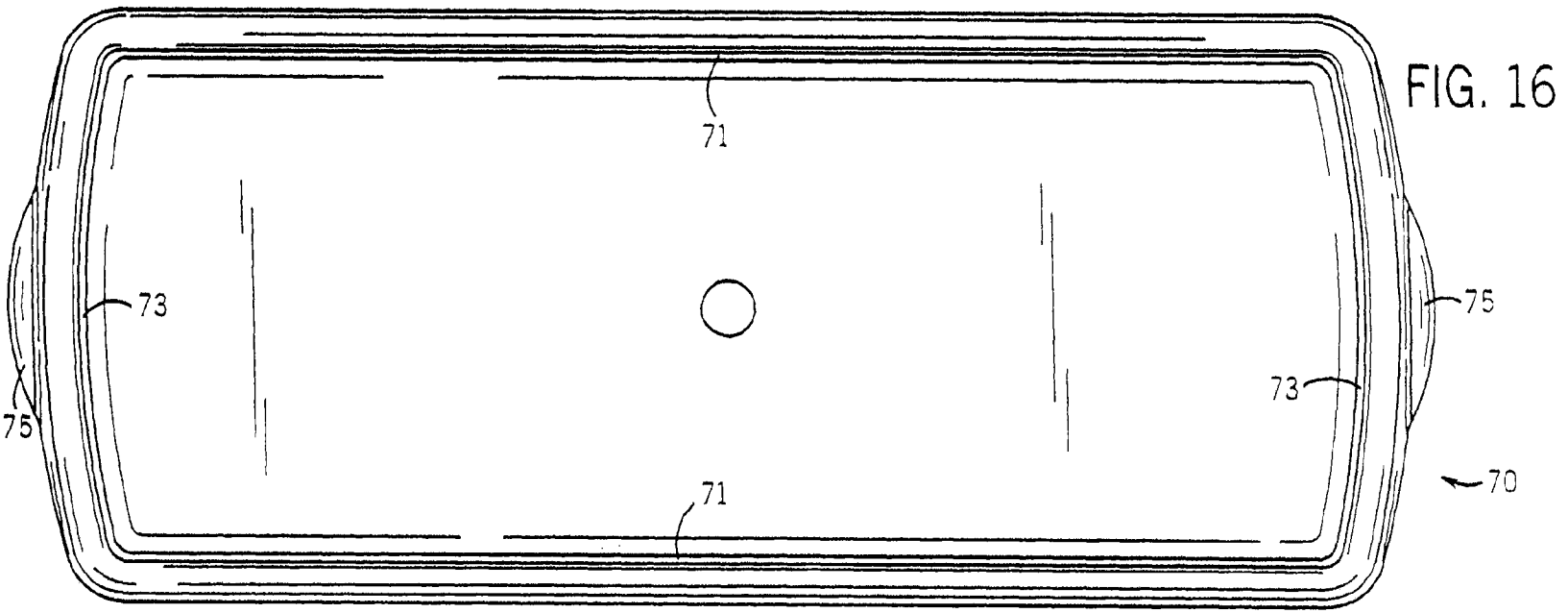
FIG. 16 is a top plan view thereof.

With reference to FIGS. 15 and 16, the storage bin 70 has a curved upper periphery or rim extending along its long sides 71 and short ends 73. The curved periphery forms two handles 75 at the short ends. The handles 75 and other portions of the curved periphery is rounded at the ends. The handles 75 generally following one radius and the other portions of the periphery generally following another, larger radius between the sides 71 such that the outer edge of the periphery is farthest from the ends 73 at about the midpoint of the handles 75. This rounded contour at the ends is designed to self-align the storage bin 70 if it is slid it into the compartment 68 misaligned or somewhat off center of the openings of the compartment 68.

As shown in FIGS. 2-3 and 10-11, an adjustable divider fence 72, shown herein in the upper drawer bin 38 (although usable in either or both the upper or lower drawing bins), has two lateral divider rods 74 spaced apart vertically and in parallel and two transverse divider rods 76 also spaced apart vertically in parallel and perpendicular to the lateral divider rods 74. The lateral divider rods 74 extend between the side walls 62 and the transverse divider rods extend between the inside of the door panel 34 and the rear wall 64, and thus in this case are shorter than the lateral divider rods 74. The pairs of divider rods 74 and 76 are coupled together and held in a perpendicular crisscross configuration by a hub 78 having a body 80 with two sets of two openings 82 (one set shown) through which the divider rods extend and an upper threaded opening 86 in which threads a locking turn knob 88. The lower end of the knob 88 is sized so that when the knob 88 is tightened it contacts the upper lateral divider rod and presses it against the upper transverse divider rod so that their relative positions are fixed (see FIG. 11). When the knob 88 is loosened, the hub 78 can be slid along the pairs of divider rods to create four compartments. When the hub 78 is centered in the drawer bin 38, the four compartments will be essentially equally sized. The fence 52 can thus be used to compartmentalize the drawer bin 39 or to keep stored items secured from movement. If it is not desired to divide up the drawer bin 38, the fence 72 can be adjusted so that the hub 78 is near one corner of the drawer bin 38 so that the lateral divider rods 74 are near the front or rear wall and the transverse divider rods 76 are near one of the side walls. Or, the entire fence 72 can be simply lifted out of the drawer bin 38. The ends of the each pair of divider rods 74 and 76 are coupled together with end assemblies 90 that include flat, cross-shaped contact pads 92 and an end piece 94, which is pressed onto the rods and ultrasonically welded over an opening in the body of the contact pads 92. Preferably, the divider rods are metal and the hub and the contact pads are plastic.

Figure 13:
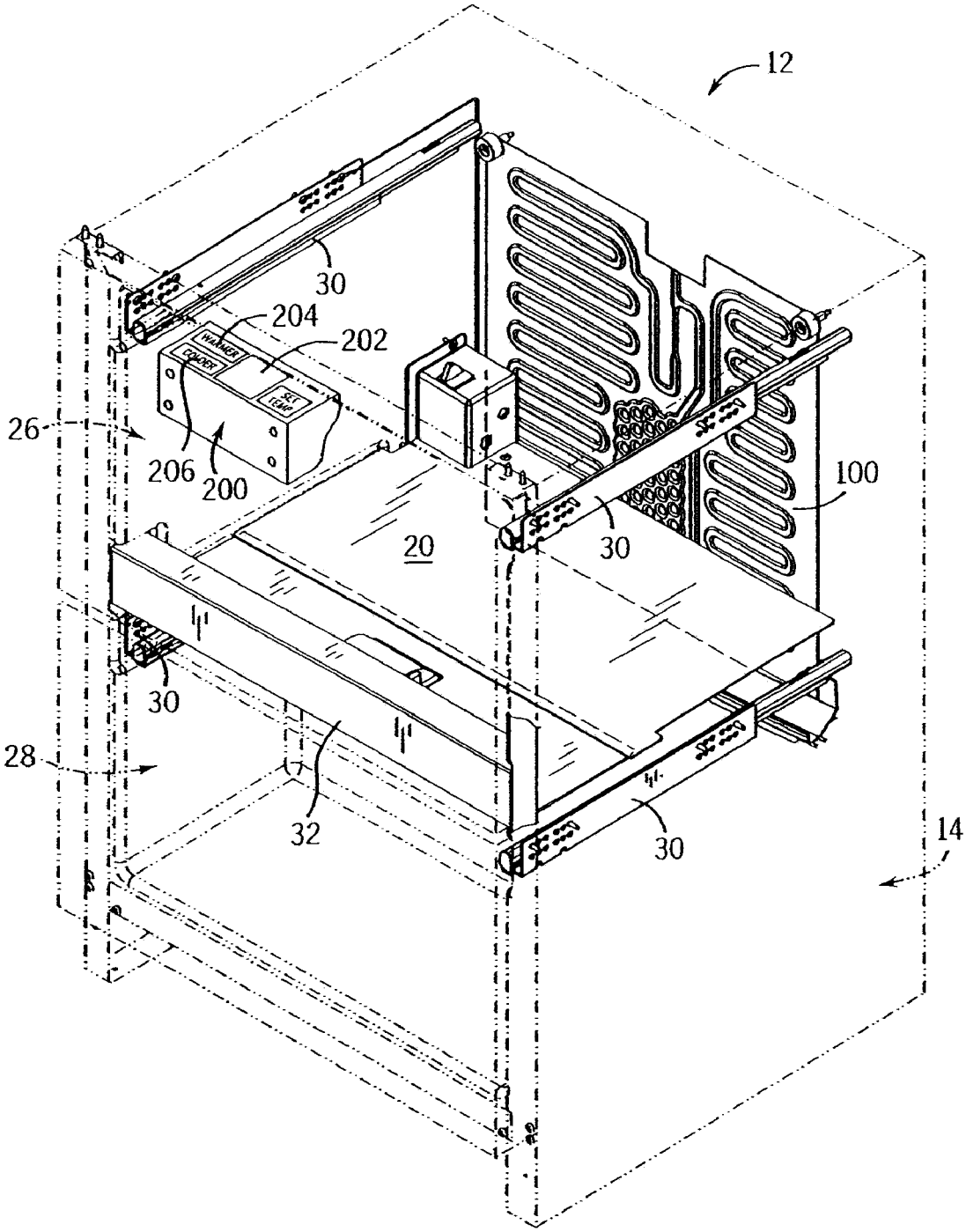
FIG. 13 is a perspective view of various internal components of the refrigerator, including slide mechanisms, a control unit, a partition and the evaporator, with the cabinet and drawers shown in phantom.
Figure 14:
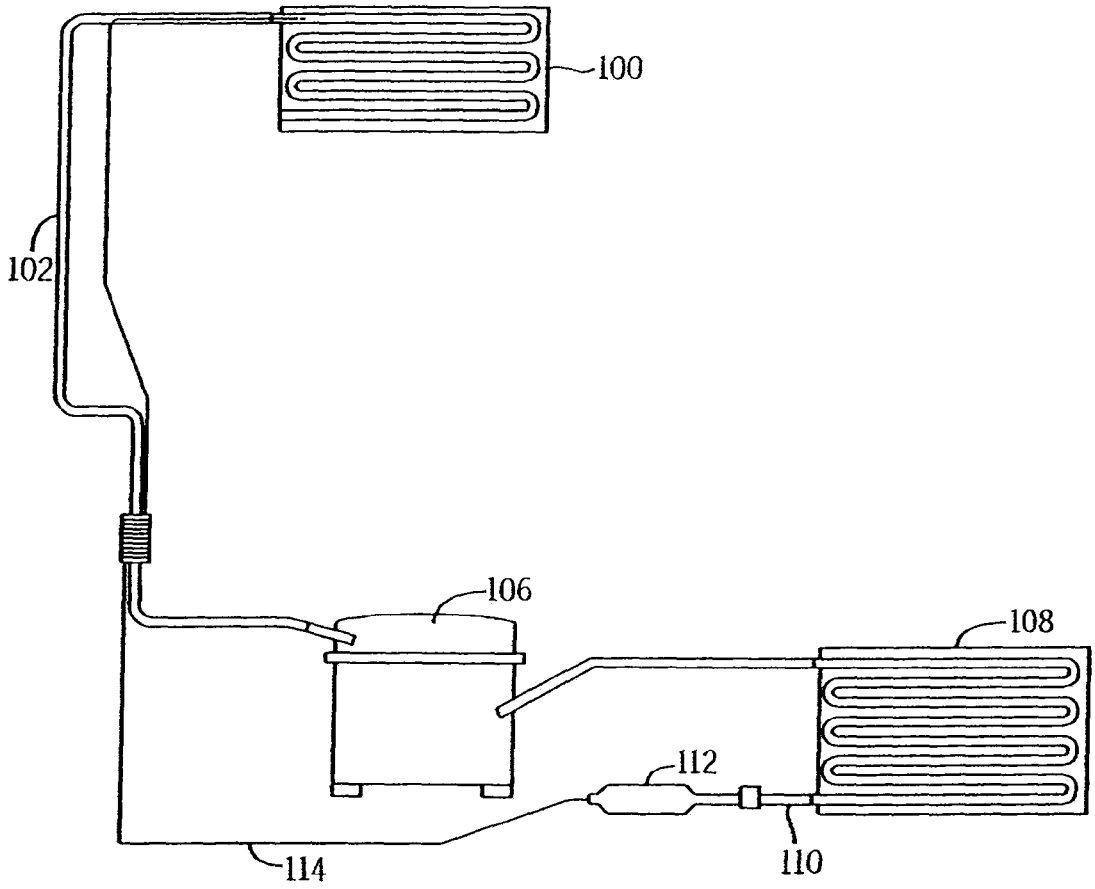
FIG. 14 is a schematic diagram of the refrigeration system of the drawer refrigerator.

The refrigerator is cooled by a generally conventional refrigeration system, shown schematically in FIG. 14, includes an evaporator 100 attached to the rear wall within the interior of the cabinet 14, as shown in FIG. 13. The evaporator 100 has an integral accumulator and an outlet line 102 which passes gas refrigerant to a compressor 106. The output of the compressor 106 is connected to the inlet of a condenser 108 having an outlet line 110 connected to a dryer 112. A small diameter capillary tube 114 leads from the dryer 112 to an inlet of the evaporator 100.

As is known, the compressor 106 draws refrigerant from the evaporator 100 and accumulator 104 and discharges the refrigerant under increased pressure and temperature to the condenser 108. The hot refrigerant gas entering the condenser 108 is cooled by air circulated by a fan 116 (see FIG. 2). As the temperature of the refrigerant drops under substantially constant pressure, the refrigerant in the condenser 108 liquefies. The capillary tube 114 maintains the high pressure in the condenser 108 and at the compressor outlet while providing substantially reduced pressure in the evaporator 100. This reduced pressure results in a large temperature drop and subsequent absorption of heat by the evaporator 100. The compressor 106, condenser 108, and fan 116 are located at the bottom of the cabinet 10 beneath the insulated portion (see FIG. 2).

The single naturally convective evaporator 100 extends along the rear wall at the inside of the cabinet so as to be adjacent both upper and lower drawer cavities 22 and 24. The horizontal partition 20, which divides the interior of the cabinet in two, is designed to divide or partition the evaporator 100 in two parts, preferably so that more (about ⅔) of the evaporator 100 is located in the upper drawer cavity 22 than in the lower drawer cavity 24, and to restrict air flow between the cavities 22 and 24 so that chilled air from the evaporator 100 is essentially trapped in each and segregated from the other drawer cavity so that the cabinet has a nearly uniform temperature at each drawer cavity 22 and 24. The partition helps prevent cold air from settling near the bottom of the cabinet and prevents the temperature in the lower drawer from being substantially cooler than that in the upper drawer. The vented rear walls of the bottle bin 48 and the upper drawer bin 38 also allow cool air from the evaporator to reach the food in the upper drawer 26, further aiding in cooling the upper part of the cabinet and equalizing the temperature in the drawers. While zero temperature differential between the drawers is desired, a five or six degree temperature variance, for example three degrees plus or minus from the target temperature, is generally an acceptable working temperature differential. Empirical tests have found that maximum temperature differences between the two drawers is 2.4° F. when the external ambient temperature is approximately 90° F. and a target cooling temperature is about 36-38° F., with the mean temperature differential being even better at 1.2° F. Because the test results may vary depending on the temperature of the food inside the drawers, for consistency the test were conducted with the refrigerator completely unloaded. Individual units tested under the same conditions achieved a nearly zero degree differential, for example 0.4° F., which is expected to improve and be at or very near zero with lower ambient temperatures (near 70° F.) common in homes and business environments. A primary benefit of this uniform temperature afforded by the refrigerator of the present invention is that, in non-freezer applications, the temperature can be set to a target temperature which approaches freezing, for example 34-36° F. with the actual temperatures within the drawer at the high end being sufficiently cool and the lower end actual temperatures remaining above freezing.

The refrigeration system is operated and controlled by a control unit 200 mounted in the interior of the upper drawer 26 (preferably in the left front corner). The control unit 200, shown in FIG. 13, has an LED display 202 providing actual and set temperature readings and has temperature adjustment buttons, preferably in the form of warmer 204 and cooler 206 sealed buttons. The control unit 200 could also have indicator lights (not shown) providing the user or service technician visual indication of refrigeration error conditions or cycle status.

Thus, the present invention provides a pull-out drawer type refrigerator with several features to improve ease of use and functionality. The sliding bottle bin provides extra storage for wine or like bottles without hampering access to the items stored in the associated drawer bin. The side access compartment also provides additional storage space in a pull out bin that is easily accessible from either side or the top of the associated drawer. The adjustable fence quickly and easily compartmentalizes the drawer bins for segregated storage of items and can be used to secure taller items in place to prevent tipping. The size of the compartments can be adjusted easily by turning the locking knob and sliding the dividers as desired. The dividers can be slid near perpendicular walls of the drawer bin or removed completely when there is no need to divide up the storage space. Finally, the invention provides for nearly constant and equal temperatures at the drawer bins of multiple pull-out drawers using a single partitioned naturally convective evaporator.

It should be appreciated that merely a preferred embodiment of the invention has been described above. However, many modifications and variations to the preferred embodiment will be apparent to those skilled in the art, which will be within the spirit and scope of the invention. Therefore, the invention should not be limited to the described embodiment. To ascertain the full scope of the invention, the following claims should be referenced.

We claim:

1. A divider fence having first and second dividers, the first divider for extending between a first pair of drawer walls and the second divider for extending between a second pair of drawer walls, the first and second dividers being coupled at a hub, which in a locked position inhibits sliding of the first divider with respect to the second divider and in an unlocked position allows sliding of the first divider with respect to the second divider.

2. The divider fence of claim 1, further including a locking member mounted to the hub at different positions when in the locked and unlocked positions.

3. The divider fence of claim 2, wherein the locking member inhibits sliding of the first divider in the locked position by contacting the first divider.

4. The divider fence of claim 2, wherein the locking member is rotatably mounted to the hub.

5. The divider fence of claim 4, wherein the locking member is a turn knob.

6. The divider fence of claim 1, wherein the hub has open-ended through openings receiving the dividers.

7. The divider fence of claim 6, wherein the openings are disposed essentially perpendicular to one another.

8. The divider fence of claim 7, wherein the first divider includes a first pair of spaced apart elongated rods and the second divider includes a second pair of spaced rods, wherein the first and second pairs of spaced rods overlap in a longitudinal dimension of the hub.

9. The divider fence of claim 6, wherein the dividers are elongated rods.

10. The divider fence of claim 9, further including end pieces mounted to ends of the elongated rods having flat surfaces for contacting the drawer walls.

11. A refrigerator, comprising;

a cabinet;

a drawer slidably mounted to the cabinet and having front, rear and opposite side walls; and a divider fence having first and second dividers, the first divider extending between the front and rear walls and the second divider extending between the side walls, the first and second dividers being coupled at a hub, which in a locked position inhibits sliding of at least one of the dividers with respect to the other divider and in an unlocked position allows sliding of the at least one divider.

12. The divider fence of claim 11, further including a locking member mounted to the hub at different positions when in the locked and unlocked positions.

13. The divider fence of claim 12, wherein the locking member inhibits sliding of the at least one divider in the locked position by contacting the at least one divider.

14. The divider fence of claim 12, wherein the locking member is rotatably mounted to the hub.

15. The divider fence of claim 14, wherein the locking member is a turn knob.

16. The divider fence of claim 11, wherein the hub has open-ended through openings receiving the dividers.

17. The divider fence of claim 16, wherein the openings are disposed essentially perpendicular to one another.

18. The divider fence of claim 17, wherein the first divider includes a first pair of spaced apart elongated rods and the second divider includes a second pair of spaced rods, wherein the first and second pairs of spaced rods overlap in a longitudinal dimension of the hub.

19. The divider fence of claim 16, wherein the dividers are elongated rods.

20. The divider fence of claim 19, further including end pieces mounted to ends of the elongated rods having flat surfaces that contact the drawer walls.

* * * * *